US008257034B2

(12) United States Patent
Tungl et al.

(10) Patent No.: US 8,257,034 B2
(45) Date of Patent: Sep. 4, 2012

(54) RADIAL FAN

(75) Inventors: Rudolf Tungl, Ergolding (DE); Roland Keber, Wörth a.d.Isar (DE)

(73) Assignee: ERM-Papst Landshut GmbH, Landshut (DE)

( * ) Notice: Subject to any disclaimer, the term of this patent is extended or adjusted under 35 U.S.C. 154(b) by 684 days.

(21) Appl. No.: 11/374,615

(22) Filed: Mar. 13, 2006

(65) Prior Publication Data

US 2006/0204382 A1 Sep. 14, 2006

(30) Foreign Application Priority Data

Mar. 14, 2005 (DE) ..... 20 2005 004 180 U

(51) Int. Cl.
*F04D 29/44* (2006.01)

(52) U.S. Cl. ..... 415/204; 415/206; 416/185

(58) Field of Classification Search ..... 415/204, 415/206, 212.1, 211.1; 416/185
See application file for complete search history.

(56) References Cited

U.S. PATENT DOCUMENTS

| | | | | | |
|---|---|---|---|---|---|
| 3,093,299 | A | * | 6/1963 | Hammann et al. | 415/90 |
| 3,824,028 | A | * | 7/1974 | Zenkner et al. | 415/58.6 |
| 4,147,467 | A | * | 4/1979 | Leicht et al. | 415/196 |
| 4,381,171 | A | * | 4/1983 | Chapple | 415/204 |
| 4,383,800 | A | * | 5/1983 | Becker et al. | 415/204 |
| 4,406,583 | A | * | 9/1983 | Becker et al. | 415/204 |
| 4,785,515 | A | * | 11/1988 | Willette | 29/888.024 |
| 5,040,947 | A | * | 8/1991 | Kajiwara et al. | 415/206 |
| 5,074,751 | A | * | 12/1991 | Sixsmith | 415/206 |
| 5,133,642 | A | * | 7/1992 | Kajiwara | 415/215.1 |
| 5,281,092 | A | * | 1/1994 | Sullivan | 415/206 |
| 5,316,439 | A | * | 5/1994 | Gatley et al. | 415/119 |
| 5,324,167 | A | * | 6/1994 | Moczadlo et al. | 415/182.1 |
| 5,474,422 | A | * | 12/1995 | Sullivan | 415/206 |
| 5,551,836 | A | * | 9/1996 | Roth et al. | 415/204 |
| 5,813,831 | A | * | 9/1998 | Matsunaga et al. | 415/173.6 |
| 5,919,030 | A | * | 7/1999 | Iwatake et al. | 415/119 |
| 5,971,292 | A | * | 10/1999 | Roy et al. | 237/53 |
| 6,056,506 | A | * | 5/2000 | Martin et al. | 415/204 |
| 6,146,095 | A | * | 11/2000 | Bross et al. | 415/204 |
| 6,224,335 | B1 | * | 5/2001 | Parisi et al. | 415/206 |
| 6,299,409 | B1 | * | 10/2001 | Matsunaga et al. | 415/206 |
| 6,468,034 | B1 | * | 10/2002 | Garrison et al. | 415/212.1 |
| 6,575,696 | B1 | * | 6/2003 | Lyons et al. | 415/119 |
| 6,604,906 | B2 | * | 8/2003 | Ozeki et al. | 415/204 |
| 6,742,989 | B2 | * | 6/2004 | Osako et al. | 415/205 |
| 6,817,832 | B2 | * | 11/2004 | Kim et al. | 415/204 |
| 7,108,482 | B2 | * | 9/2006 | Chapman | 416/185 |

(Continued)

FOREIGN PATENT DOCUMENTS

| | | |
|---|---|---|
| DE | 102 31 983 | 2/2003 |

(Continued)

*Primary Examiner* — Edward Look
*Assistant Examiner* — Sean J Younger
(74) *Attorney, Agent, or Firm* — Harness, Dickey & Pierce, PLC

(57) ABSTRACT

A radial fan comprises a casing having a side portion and a pot-like casing portion, an impeller wheel arranged therein and having radially extending blades, an electric motor arranged at the side portion, and a pressure chamber which is formed by the casing portion and the side portion. The pressure chamber with the impeller wheel space between the blades forms in cross-section a nozzle in the manner of a venturi nozzle. The ratio of the greatest blade height H/greatest diameter D of the scroll is substantially between H/D=0.08 and H/D=0.3.

42 Claims, 4 Drawing Sheets

U.S. PATENT DOCUMENTS

| | | | | |
|---|---|---|---|---|
| 2002/0106277 | A1* | 8/2002 | Chapman | 415/206 |
| 2002/0119044 | A1* | 8/2002 | O'Connor et al. | 415/204 |
| 2003/0053910 | A1* | 3/2003 | Hosny | 415/205 |
| 2004/0126228 | A1* | 7/2004 | Roudnev et al. | 415/196 |
| 2004/0219013 | A1* | 11/2004 | Hopfensperger | 415/206 |
| 2006/0034687 | A1* | 2/2006 | Schober et al. | 415/206 |

FOREIGN PATENT DOCUMENTS

| | | |
|---|---|---|
| DE | 103 13 054 | 10/2004 |
| EP | 0 410 271 | 1/1991 |
| EP | 0 450 272 | 10/1991 |
| WO | WO 90/09524 | 8/1990 |

* cited by examiner blade (impeller wheel)

ratio
blade height / diameter of the scroll:

$$\frac{H}{D} = \frac{18}{145.3} = 0.12$$

RADIAL FAN

CROSS-REFERENCES TO RELATED APPLICATIONS

This application claims the priority of German Utility model application Serial No 20 2005 004 180.7 filed Mar. 14, 2005, the subject-matter of which is incorporated herein by reference.

FIELD

The invention concerns generally a radial fan.

BACKGROUND

A radial fan which can be considered as a typical configuration comprises a casing having a side portion and a pot-like casing portion, with an impeller wheel which is arranged in the casing and which has radially extending vanes or blades.

Such a fan for conveying gaseous media is generally used in items of equipment which involve a high flow resistance. That can involve for example a cylinder burner or a ceramic surface burner which are used in the most recent developments in gas boilers. Gas heating boilers of that kind may often involve a flow resistance of the order of magnitude of 800 Pascals and more. To ensure stable operating points, the endeavour is to produce pressure-volume characteristics which are as steep as possible, when employing a radial fan.

As an example of such a radial fan reference may be made to EP 0 410 271 A1 disclosing a unit for conveying a gaseous medium, in which the housing portion of the radial fan has a holder for an electric motor for driving the impeller wheel while the side portion is provided with an inlet opening for the feed flow of the fan air.

SUMMARY

An object of the invention is to provide a radial fan which while affording an output which is as far as possible the same is particularly compact and inexpensive and simple to produce.

Another object of the present invention is to provide a radial fan which affords a rational structure and which can enjoy reduced pressure losses.

Yet another object of the present invention is to provide a radial fan so designed as to afford a satisfactory output without an increase in noise level.

In accordance with the principles of the present invention the foregoing and other objects are attained by a radial fan comprising a casing having a side portion and a pot-like casing portion. An impeller wheel is arranged therein and has radially extending blades. An electric motor is arranged at the side portion and a pressure chamber which is formed by the casing portion and the side portion, together with the impeller wheel space between the blades of the impeller wheel, forms in cross-section a nozzle in the manner of a venturi nozzle. The ratio of the greatest blade height denoted by H/greatest diameter denoted by D of the scroll or spiral of the radial fan is substantially between H/D=0.08 and H/D=0.3.

As will be seen from the description of a preferred embodiment of the radial fan as set forth in hereinafter, the particular configuration of the above-mentioned pressure chamber geometry and the design of the blades of the impeller wheel in relation to the diameter of the scroll of the pressure chamber provides that the desired output levels are excellently well achieved.

In accordance with a preferred feature the ratio of the greatest blade height to the greatest diameter of the scroll is 0.1, while in accordance with a still further preferred feature that ratio is 0.12. In a structural configuration of the radial fan that can correspond to a largest diameter of about 145.3 mm with a blade height of 18 mm.

In a further preferred feature of the invention provided in the casing portion and/or in the side portion are enlargement cavities or recess portions which continuously three-dimensionally enlarge the spiral-shaped pressure chamber.

In another preferred feature the enlargement cavity or recess portion in the casing portion is larger than that in the side portion. Such a choice in respect of the casing configuration and the arrangement of the larger enlargement cavity or recess portion in the casing portion affords the possible option of providing those recess portions on the side of the fan casing that is remote from the motor, thereby affording a configuration which is generally desired, without involving spatial limitation.

In a preferred feature the ratio of the height to the diameter of the casing can be between 1:7 and 1:9, that ratio in a particularly preferred feature being substantially 1:8.

It is further preferred if, at a rotary speed of n=5250, an air flow by volume of about 11 l/s is delivered at a pressure of 1050 Pascals. That corresponds to a shaft power of about 21 W. That is a very low value in comparison with previous radial fan design configurations.

A further advantageous configuration of the radial fan according to the invention provides that the plane of the connection to the delivery duct of the casing is at an angle $\alpha \leqq 90°$ relative to the delivery direction, denoted by A hereinafter. It is particularly advantageous if the angle is between 90° and 83°, preferably being 86.4°.

A further advantageous configuration of the invention can provide that the delivery duct is afforded on the casing portion.

In another preferred feature the delivery duct can be of a configuration which enlarges trumpet-like.

In a further-preferred feature of the invention the casing can have a tongue portion which extends into the pressure chamber. In that case it is desirable for the tongue portion on the casing portion to be in the form of a ramp which rises in the flow direction on the side wall of the casing portion. The provision of a tongue portion in that way means that the pressure chamber is screened or shielded in relation to the impeller wheel in the delivery region so that pressure losses can be reduced in that fashion.

In a further preferable configuration of the invention it may be advantageous for the tongue portion to be provided on the side portion in the form of a ramp rising in the flow direction towards the casing portion. Providing the tongue portion in the form of the ramp in that way means that the gap between the impeller wheel and the side wall of the casing portion can be reduced without an increase in noise level.

In accordance with yet a further preferred feature of the invention the impeller wheel can include a hub and at least one cover disk, for example a front cover disk, in which case then the blades of the impeller wheel are only held to the hub and the cover disk. It is then possible to dispense with a rearward carrier disk. That configuration can involve inexpensive manufacture of the impeller wheel and thus the radial fan overall.

Further objects, features and advantages of the present invention will be apparent from the description hereinafter of a preferred embodiment thereof.

DRAWINGS

DETAILED DESCRIPTION

Figure 1:
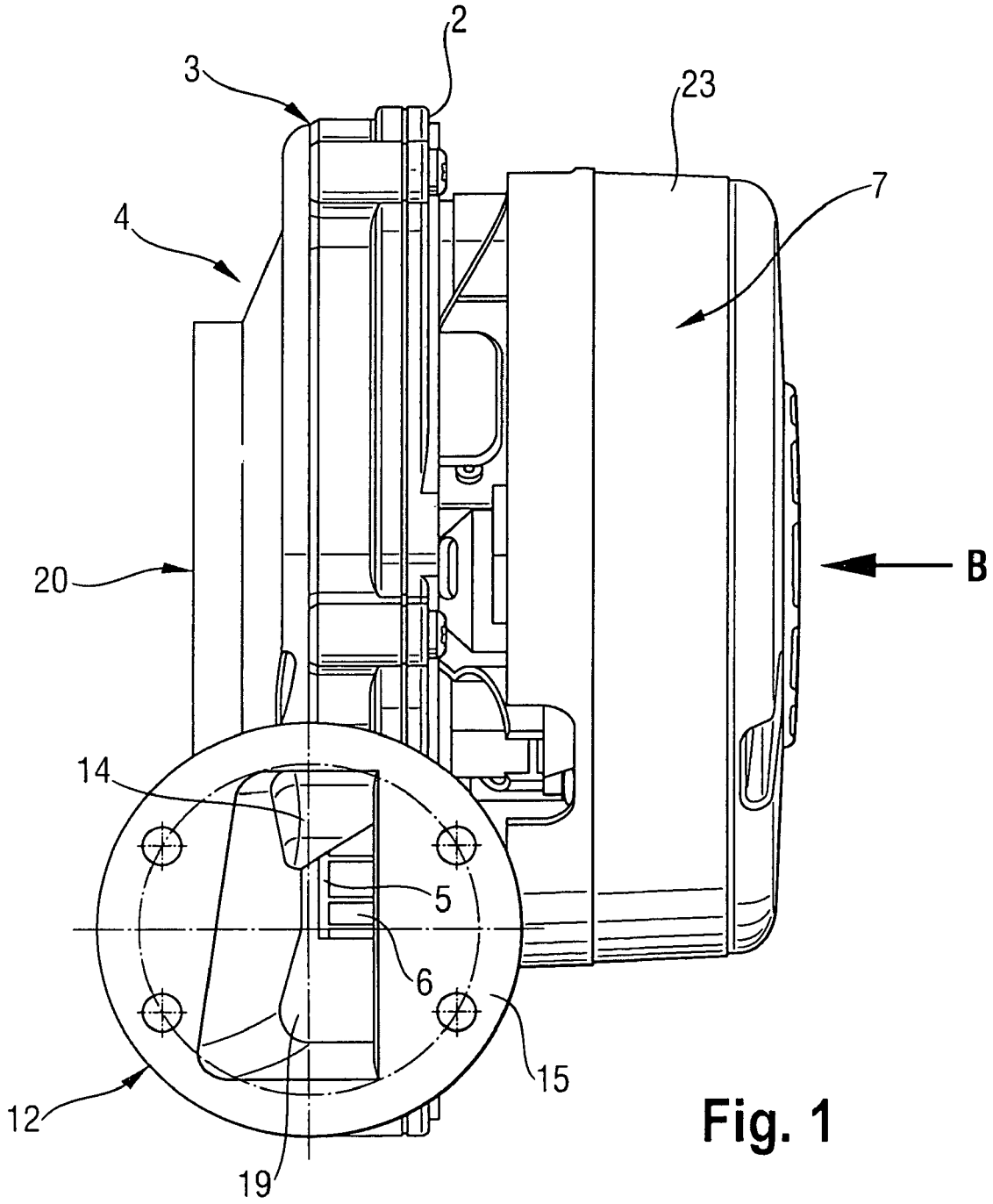
FIG. 1 shows a side view of a radial fan.

Referring firstly to FIG. 1, shown therein is a side view of a radial fan according to the invention comprising a casing generally identified by reference 4, in which an impeller wheel 5 is rotatably accommodated. The casing 4 comprises a side portion 2 and a pot-like casing portion 3. An electric motor 7 is mounted to the side portion 2 in vibration-damped relationship. The electric motor 7 has a motor shaft for driving the impeller wheel 5 in rotation. The electric motor 7 is covered with a cap 23 which also accommodates the appropriate electronic system which is not shown here for the sake of simplicity of the drawing.

The casing 4 has a pressure chamber which is identified by reference 8 in FIG. 3 and which will be described in greater detail hereinafter. The impeller wheel 5, together with the pressure chamber 8, as will also be described in greater detail with reference to FIG. 3, forms in cross-section a nozzle in the manner of an idealised venturi nozzle, with the narrowest cross-section of the venturi nozzle being in the transition between the impeller wheel and the casing 4.

Figure 2:
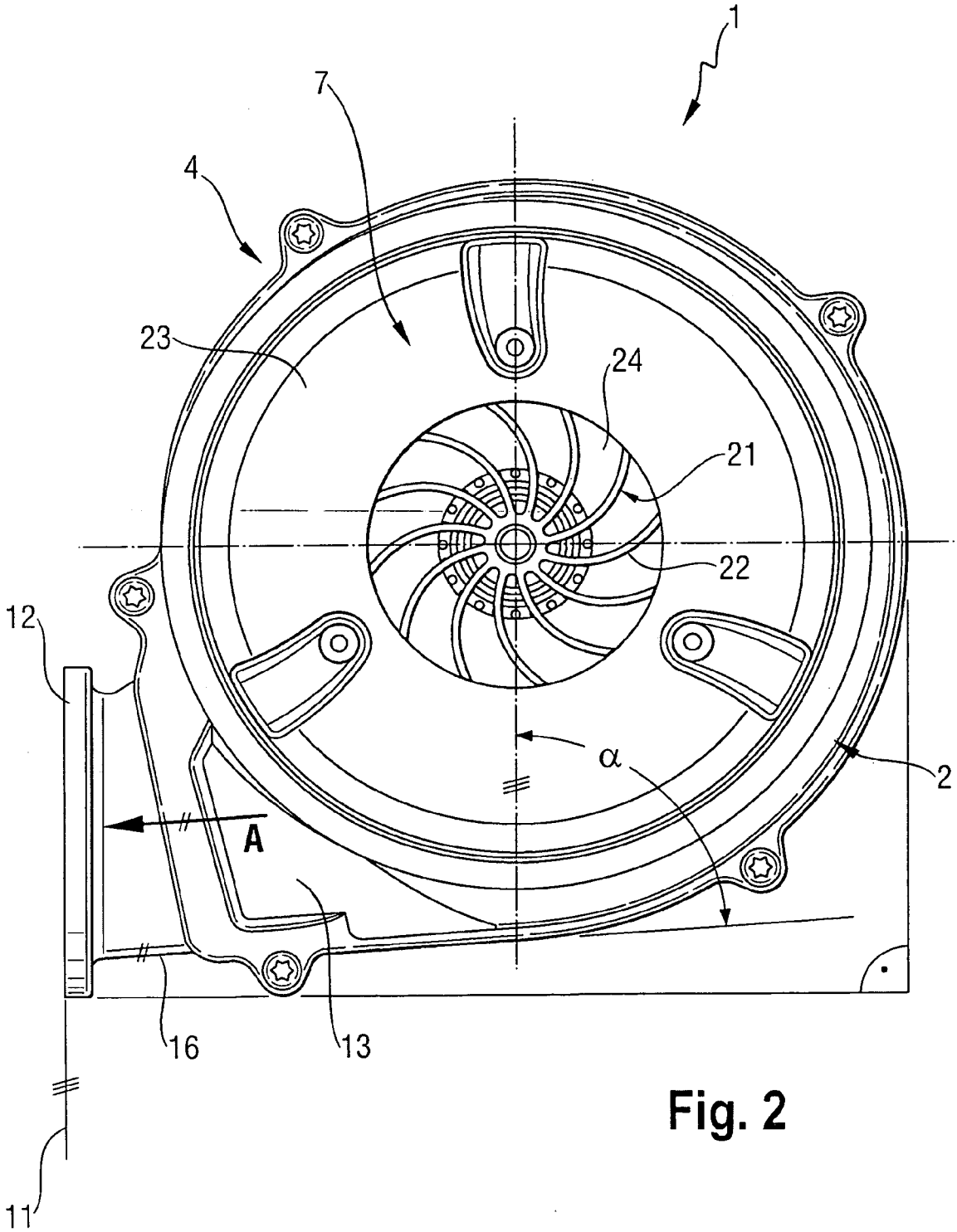
FIG. 2 shows a front view on to the radial fan with motor and connecting flange viewing in the direction indicated by the arrow B in FIG. 1.

Looking now again at FIG. 1 in conjunction with FIG. 2, the casing 4 has a suction intake opening 20 and a delivery duct 13. A connection 12 in the form of a flange is provided at the free end of the delivery duct 13, as can be clearly seen from FIG. 2.

Provided in the casing portion 3 and/or in the side portion 2 are enlargement cavities or recess portions indicated at 19 in FIG. 1 and referred to hereinafter as enlargement portions. The enlargement portions 19 provide that the spiral-shaped pressure chamber 8 is continuously three-dimensionally enlarged.

In the illustrated embodiment the enlargement portion 19 in the casing portion 3 is larger than in the side portion 2.

Reference will now be made to FIG. 2 showing a view of the radial fan in the direction of the arrow indicated at B in FIG. 1. The cap 23 covering the electric motor has a central cooling air opening 24, through which an impeller wheel 21 with rearwardly curved impeller wheel vanes or blades 22 is visible.

The connection 12 of the delivery duct 13 is disposed in a plane indicated at 11 which in the illustrated embodiment forms an angle of $\alpha \leqq 90°$ with the theoretical air discharge or delivery direction as indicated by the arrow A in FIG. 2. In a preferred configuration the angle $\alpha$ is between 90° and 83°, preferably being 86.4° in a still more preferred configuration. That design configuration provides that the issuing flow of air is still further reduced in pressure as the enlargement of the side wall 16 of the pressure chamber 8, at the beginning of the delivery duct 13, beyond the tangential continuation 16' of the side wall to afford a trumpet-like configuration, as can also be seen in particular from FIG. 3, involves an additional reduction in speed and thus an increase in pressure. In that case the trumpet configuration is formed by the side walls indicated by references 16 and 16" in FIG. 3. In the illustrated view the theoretical air delivery direction indicated by the arrow A and the side wall 16 of the duct, identified by two parallel lines, extend in mutually parallel relationship. Equally the perpendicular centre line of the fan and the plane 11 are in mutually parallel relationship.

Figure 3:
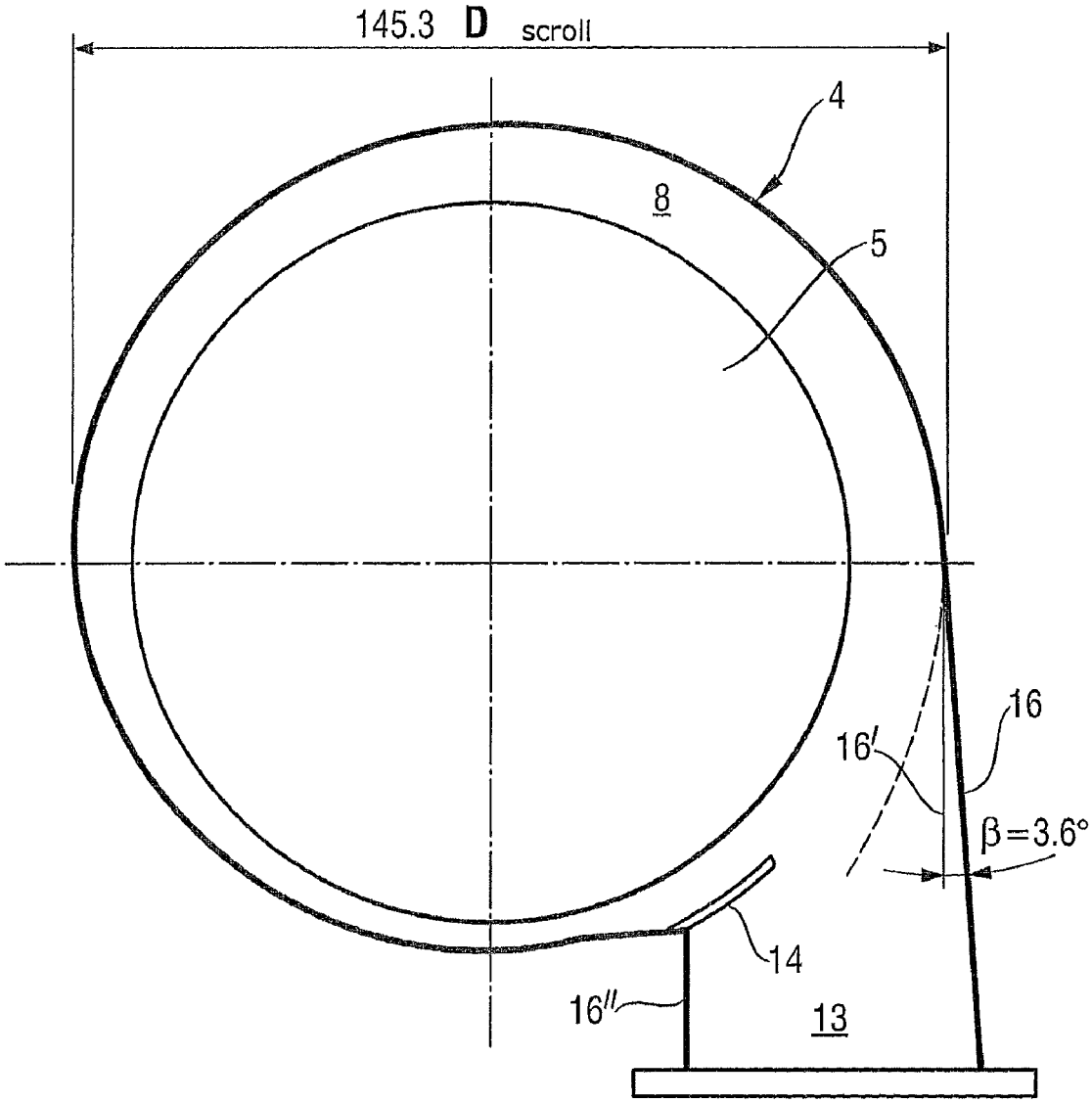
FIG. 3 is a diagrammatic view showing the pressure chamber of the radial fan.
Figure 3:
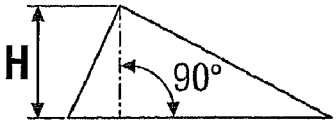

Reference will now be made to FIG. 3 diagrammatically showing the radial fan casing 4 in which the fan wheel 5 is disposed. The spiral-shaped pressure chamber 8 is screened or shielded in relation to the impeller wheel 5 in the region of the delivery duct 13 by a tongue portion 14.

As can be clearly seen from FIG. 3 the tongue portion 14 is provided on the casing portion 3 in the form of a ramp rising in the direction of flow of the air, on the front wall of the casing portion 3. Alternatively, the ramp can be provided on the side portion 2 and rise in the direction of flow towards the casing portion 3. In that case it may also be provided that the ramp is of a stepped configuration. In this view the angle of the trumpet configuration is shown as a complementary angle to the above-mentioned angle $\alpha$, indicated by $\beta=3.6°$.

In accordance with the invention the ratio of the greatest blade height indicated by H in FIG. 3 to the diameter of the radial fan scroll or spiral as indicated by D in FIG. 3 is between substantially 0.08 and 0.3, being 0.12 in the illustrated embodiment. During series of tests it was found that deviations from that last-specified ratio still afford usable results, but that value of 0.12, with a scroll diameter of 145.3 mm and a delivery flow by volume of 11 l/s at a pressure of 1050 Pascals, is the optimum parameter. That working point can be achieved at a rotary speed which can be denoted by n of 5250 rpm with a shaft power of 21 W.

Figure 4:
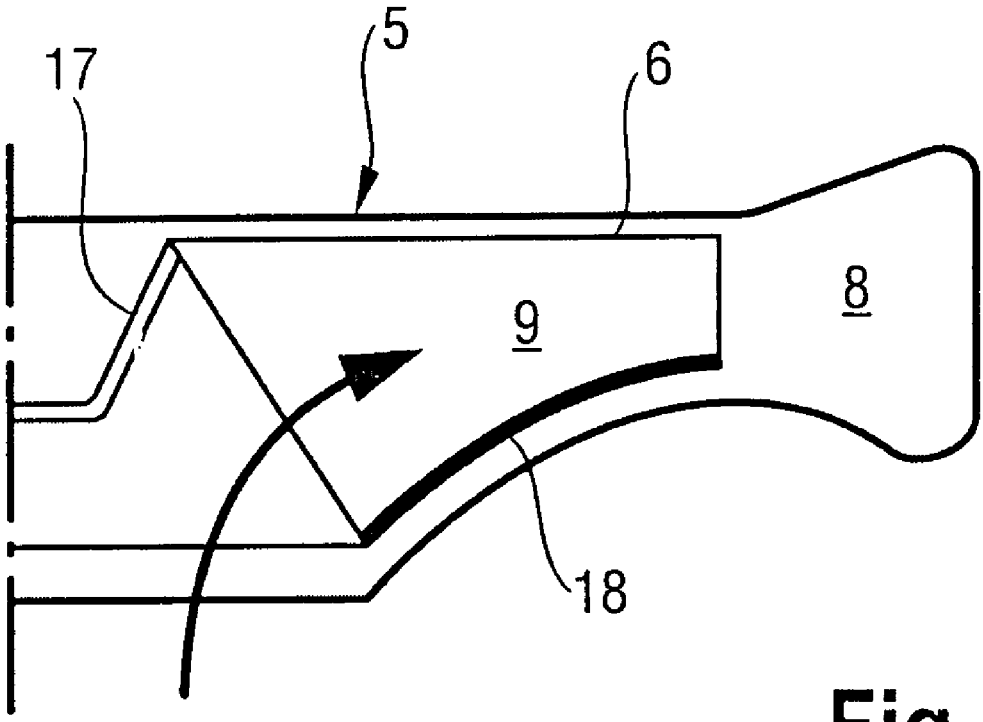
FIG. 4 shows a diagrammatic view in section of the association between the impeller wheel space and the pressure chamber of the radial fan.

Attention is now directed to FIG. 4 diagrammatically showing the venturi nozzle principle embodied in the present invention insofar as the pressure chamber 8 formed by the casing portion 3 and the side portion 2 together with the impeller wheel space between the blades 6 of the impeller wheel forms in cross-section a nozzle which is in the nature of a venturi nozzle. Reference 9 in FIG. 4 denotes the impeller wheel space referred to above. In addition to the rotary speed of the impeller wheel, the region 9, due to the structural configuration thereof, causes a further acceleration in the air flow whereas the pressure chamber 8 brings about an increase in pressure and causes calming of the air flow.

In the embodiment illustrated in the accompanying Figures, as is diagrammatically shown most clearly in FIG. 4, the impeller wheel 5 is provided with a hub 17, the blades 6 being mounted to the hub 17 and to a cover disk 18, constituting a front cover disk. It will be appreciated that it is also possible to use different impeller wheels according to respectively desired output and efficiency requirements.

It will be further appreciated that the above-described embodiment has been set forth solely by way of example and illustration of the principles of the invention and that various modifications and alterations may be made therein without thereby departing from the spirit and scope of the invention.

What is claimed is:

1. A radial fan comprising:

a casing having a front wall, an inlet, an outlet, a side portion defining a planar wall, a pot-shaped casing portion and defining a casing scroll, an impeller wheel in the casing including a hub, a cover disc and a plurality of radially extending blades extending between the hub and the cover disc each of the plurality of radially extending blades defining a straight edge disposed parallel to and immediately adjacent the planar wall of the side portion of the casing, the impeller drawing fluid in through the inlet at a radial center portion of the impeller wheel and blowing the fluid out the outlet at a radial outer portion of the impeller wheel, an electric motor at the side portion, a pressure chamber formed by the casing portion and the side portion, and a flow channel for said fluid extending between said inlet and said outlet being defined by said planar wall of said side portion of said casing, adjacent blades of said impeller wheel, said hub and said cover disc, said flow channel extending between the hub and the cover disc to form in a cross-section a nozzle in the manner of a venturi nozzle; wherein a narrowest cross-section of the venturi nozzle is defined by a surface of the impeller wheel at an outer circumferential edge of the impeller wheel and a surface of the planar wall of the side portion of the casing, the narrowest cross-section extending perpendicular to the planar wall of the side portion;

the ratio of the greatest blade height H/greatest diameter D of the casing scroll is between H/D=0.08 and H/D=0.3, the casing has a tongue portion extending into said pressure chamber; and said tongue portion is provided on the casing portion in the form of a ramp which rises in the flow direction on the front wall of the casing portion.

2. A radial fan as set forth in claim 1, wherein the ratio of the greatest blade height H/greatest diameter D of the casing scroll is substantially H/D=0.1.

3. A radial fan as set forth in claim 1, wherein the ratio of the greatest blade height H/greatest diameter D of the casing scroll is substantially H/D=0.12.

4. A radial fan as set forth in claim 1 including enlargement cavity portions in at least one of the casing portion and the side portion, the enlargement cavity portions continuously three-dimensionally enlarging the pressure chamber.

5. A radial fan as set forth in claim 4, wherein the casing portion and the side portion have said enlargement cavity portions and the enlargement cavity portion in the casing portion is larger than said portion in the side portion.

6. A radial fan as set forth in claim 1, wherein the height/diameter ratio of the casing is between 1:7 and 1:9.

7. A radial fan as set forth in claim 6, wherein the height/diameter ratio of the casing is substantially 1:8.

8. A radial fan as set forth in claim 1, wherein with a rotary speed of about n=5250 rpm a gas volume flow of about 11 l/s at a pressure of 1050 Pascals is delivered, which corresponds to a shaft power of about 21 W.

9. A radial fan as set forth in claim 1, wherein the casing defines a delivery duct for the discharge of gas from the fan and including:

a connection means on the delivery duct of the casing, said connection means defining a first plane, wherein said first plane is at an angle $\alpha \leqq 90°$ relative to a delivery direction.

10. A radial fan as set forth in claim 9, wherein said first plane is at an angle of $90° > \alpha \geqq 83°$ relative to the delivery direction.

11. A radial fan as set forth in claim 9, wherein said first plane is at an angle of 86.4° relative to the delivery direction.

12. A radial fan as set forth in claim 9, wherein said delivery duct is provided on said casing portion.

13. A radial fan as set forth in claim 9, wherein said delivery duct is of a trumpet enlarging configuration.

14. A radial fan as set forth in claim 1, wherein said impeller wheel and said blades are held only to said hub and to the cover disk.

15. A radial fan comprising:

a casing having a side portion defining a planar wall, an inlet, an outlet and a pot-shaped casing portion and defining a casing scroll, an impeller wheel in the casing including a hub, a cover disc and a plurality of radially extending blades extending between the hub and the cover disc each of the plurality of extending blades defining a straight edge disposed parallel to and immediately adjacent the planar wall of the side portion of the casing, the impeller drawing fluid in through the inlet at a radial center portion of the impeller wheel and blowing the fluid out the outlet at a radial outer portion of the impeller wheel, wherein said casing portion has a front wall, an electric motor at the side portion, and a pressure chamber which is formed by the casing portion and the side portion, a flow channel for said fluid extending between said inlet and said outlet being defined by said planar wall of said side portion of said casing, adjacent blades of said impeller wheel, said hub and said cover disc, said flow channel extending between the hub and the cover disc to form in a cross-section a nozzle in the manner of a venturi nozzle; wherein wherein a narrowest cross-section of the venturi nozzle is defined by a surface of the impeller wheel at an outer circumferential edge of the impeller wheel and a surface of the planar wall of the side portions of the casing, the narrowest cross-section extending perpendicular to the planar wall of the side portion;

wherein the ratio of the greatest blade height H/greatest diameter D of the casing scroll is between H/D=0.08 and H/D=0.3, wherein said casing has a tongue portion extending into said pressure chamber, and wherein said tongue portion is provided on said side portion in the form of a ramp which rises in the flow direction towards said side portion.

16. A radial fan as set forth in claim 15, wherein the ratio of the greatest blade height H/greatest diameter D of the casing scroll is H/D=0.1.

17. A radial fan as set forth in claim 15, wherein the ratio of the greatest blade height H/greatest diameter D of the casing scroll is H/D=0.12.

18. A radial fan as set forth in claim 15 including enlargement cavity portions in at least one of the casing portion and the side portion, the enlargement cavity portions continuously three-dimensionally enlarging the pressure chamber.

19. A radial fan as set forth in claim 18, wherein the casing portion and the side portion have said enlargement cavity portions and the enlargement cavity portion in the casing portion is larger than said portion in the side portion.

20. A radial fan as set forth in claim 15, wherein the height/diameter ratio of the casing is between 1:7 and 1:9.

21. A radial fan as set forth in claim 20, wherein the height/diameter ratio of the casing is 1:8.

22. A radial fan as set forth in claim 19, wherein with a rotary speed of about n=5250 rpm a gas volume flow of about 11 l/s at a pressure of 1050 Pascals is delivered, which corresponds to a shaft power of about 21 W.

23. A radial fan as set forth in claim 15, wherein the casing defines a delivery duct for the discharge of gas from the fan and including:

a connection means on the delivery duct of the casing, said connection means defining a first plane, wherein said first plane is at an angle $\alpha < 90°$ relative to the delivery direction.

24. A radial fan as set forth in claim 23, wherein said first plane is at an angle 90°>α>83° relative to the delivery direction.

25. A radial fan as set forth in claim 23, wherein said first plane is at an angle of 86.4° relative to the delivery direction.

26. A radial fan as set forth in claim 23, wherein said delivery duct is provided on said casing portion.

27. A radial fan as set forth in claim 23, wherein said delivery duct is of a trumpet enlarging configuration.

28. A radial fan as set forth in claim 1, wherein said blades are held only to said hub and to the cover disk.

29. A radial fan as set forth in claim 1, wherein a widest cross-section of the venturi nozzle is disposed at a radially inward portion of the radially extending blades and the narrowest cross-section of the venturi nozzle is disposed at a radially outward position of the radially extending blades.

30. A radial fan as set forth in claim 15, wherein a widest cross-section of the venturi nozzle is disposed at a radially inward portion of the radially extending blades and the narrowest cross-section of the venturi nozzle is disposed at a radially outward position of the radially extending blades.

31. A radial fan as set forth in claim 1, wherein the narrowest cross-section being defined by a surface of the cover disc and the surface of the casing.

32. A radial fan as set forth in claim 15, wherein the narrowest cross-section being defined by a surface of the cover disc and the surface of the casing.

33. The radial fan as set forth in claim 1, wherein each of the plurality of radially extending blades includes a curved edge disposed on a side of the blade immediately adjacent the inlet and a straight edge disposed on a side of the blade opposite the curved edge, the cover disc being disposed on the curved edge, the hub being disposed on the straight edge.

34. The radial fan as set forth in claim 15, wherein each of the plurality of radially extending blades includes a curved edge disposed on a side of the blade immediately adjacent the inlet and a straight edge disposed on a side of the blade opposite the curved edge, the cover disc being disposed on the curved edge, the hub being disposed on the straight edge.

35. The radial fan as set forth in claim 1, wherein said hub is directly attached to a first side of said plurality of blades and said cover disc is directly attached to a second side of said plurality of blades opposite to said first side, said flow channel extending between said first and second side of said plurality of blades.

36. The radial fan as set forth in claim 15, wherein said hub is directly attached to a first side of said plurality of blades and said cover disc is directly attached to a second side of said plurality of blades opposite to said first side, said flow channel extending between said first and second side of said plurality of blades.

37. The radial fan according to claim 1, wherein the flow channel includes a first section defined by the hub and not by the adjacent blades and a second section defined only by the adjacent blades of the impeller wheel, the cover disc and the planar wall of the side portion of the casing, the second section being disposed immediately after the first section in a flow direction of the fluid.

38. The radial fan according to claim 15, wherein the flow channel includes a first section defined by the hub and not by the adjacent blades and a second section defined only by the adjacent blades of the impeller wheel, the cover disc and the planar wall of the side portion of the casing, the second section being disposed immediately after the first section in a flow direction of the fluid.

39. The radial fan according to claim 1, wherein the cover disc begins at an innermost radial end of the plurality of radially extending blades and ends at an outermost radial end of the plurality of radially extending blades.

40. The radial fan according to claim 15, wherein the cover disc begins at an innermost radial end of the plurality of radially extending blades and ends at an outermost radial end of the plurality of radially extending blades.

41. The radial fan according to claim 1, wherein a radially inner end of each of the plurality of radially extending blades extends between an innermost radial end of the cover and an outermost radial end of the hub.

42. The radial fan according to claim 15, wherein a radially inner end of each of the plurality of radially extending blades extends between an innermost radial end of the cover and an outermost radial end of the hub.

* * * * *

UNITED STATES PATENT AND TRADEMARK OFFICE

CERTIFICATE OF CORRECTION

PATENT NO. : 8,257,034 B2
APPLICATION NO. : 11/374615
DATED : September 4, 2012
INVENTOR(S) : Rudolf Tungl et al.

It is certified that error appears in the above-identified patent and that said Letters Patent is hereby corrected as shown below:

Title Page, (73) Assignee, "ERM-Papst Landshut GmbH"
should be -- EBM-Papst Landshut GmbH --

Col. 6, line 57, claim 22, replace "claim 19"
with -- claim 15 --

Signed and Sealed this
Eighteenth Day of December, 2012

David J. Kappos

David J. Kappos
*Director of the United States Patent and Trademark Office*